United States Patent [19]

Dzewaltowski et al.

[11] Patent Number: 4,561,218

[45] Date of Patent: Dec. 31, 1985

[54] CLOSE TOLERANCE INTERNAL GRINDING USING COOLANT MIST

[75] Inventors: Victor F. Dzewaltowski, Springfield; Steven P. Farmer, North Springfield, both of Vt.

[73] Assignee: Ex-Cell-O Corporation, Troy, Mich.

[21] Appl. No.: 699,707

[22] Filed: Feb. 8, 1985

[51] Int. Cl.[4] ..... B24B 1/00

[52] U.S. Cl. ..... 51/290; 51/165.93; 51/267

[58] Field of Search ..... 51/165.93, 290, 291, 51/267, 322

[56] References Cited

U.S. PATENT DOCUMENTS

| | | | |
|---|---|---|---|
| 1,534,393 | 4/1925 | Joseph | 51/290 |
| 3,423,887 | 1/1969 | Strom | 51/291 |
| 4,193,227 | 3/1980 | Uhtenwoldt | 51/291 |

FOREIGN PATENT DOCUMENTS

| | | | |
|---|---|---|---|
| 2131489 | 2/1972 | Fed. Rep. of Germany | 51/267 |

*Primary Examiner*—Harold D. Whitehead
*Attorney, Agent, or Firm*—Edward J. Timmer

[57] ABSTRACT

In the internal grinding of a cylindrical bore having an oil or similar groove which adversely affects the bore roundness achievable, one or more streams of liquid coolant are directed over the grinding wheel during rough grinding at a high wheel feed rate and only a mist of liquid coolant droplets suspended in a compressed air stream is directed over the wheel once the high wheel feed rate has been reduced to the lower wheel feed rate associated with finish grinding. Means are provided for terminating the liquid coolant streams at the time the wheel feed rate is changed or after a short delay period thereafter to establish equilibrium finish grind conditions. Preferably, the change from one or more liquid coolant streams to the coolant mist is made in response to a detected decrease in wheel spindle motor power.

7 Claims, 4 Drawing Figures

CLOSE TOLERANCE INTERNAL GRINDING USING COOLANT MIST

FIELD OF THE INVENTION

The present invention relates to internal grinding, especially of a bore of extended length having an axial, helical or other interruption, such as an oil groove, in the bore wall.

BACKGROUND OF THE INVENTION

The internal grinding of a long bore with an oil or similar axial or helical groove within close bore roundness tolerance has been fraught with difficulties in the past. Typically, the roundness of the bore is difficult to maintain within a given tolerance within the vicinity of the interruption, i.e., oil or other groove, in the bore wall.

It is thought that the interruption in the bore wall contributes to out-of-tolerance bore roundness by allowing loss or collapse of the hydrodynamic coolant pressure film in the vicinity of the groove. That is, the groove provides a ready escape path for the coolant film. Prior art workers have attempted to deal with this problem by grinding without coolant altogether or by discontinuing liquid coolant flow after rough grinding and before finish grinding or after rough and finish grinding but before the final spark-out or dwell phase of grinding during which the grinding wheel is not fed into the workpart bore wall but rather is allowed simply to remain in contact with the bore wall until grinding force decreases to the so-called threshold level below which no further grinding occurs. However, it has been very difficult to determine and establish the right conditions for effecting sufficient dry grinding to round-up the bore without damaging the grinding wheel so as not to compromise bore straightness and surface finish. Attempts to reduce, rather than completely shut off, flow of the liquid coolant stream have also failed as a result of the relatively small quantity of coolant involved and the great difficulty in controlling or limiting its distribution uniformly along the length of the bore.

SUMMARY OF THE INVENTION

The present invention provides a grinding process for grinding a relatively long workpart bore with a groove or similar interruption in the bore wall to within close bore roundness tolerance wherein rough grinding of the bore wall at a relatively high wheel feed rate is effected while flowing a liquid coolant stream over the grinding wheel and wherein finish grinding of the bore wall at a lower wheel feed rate is effected while a coolant mist (coolant droplets suspended or carried in a gaseous stream) is discharged over the wheel without flow of any liquid coolant stream. Change from a liquid coolant stream to a coolant mist is made typically when the fast wheel feed rate associated with rough grinding is changed to the slower wheel feed rate associated with finish grinding or slightly later than the change from the high to the low feed rate so that the actual grinding rate has had time to decrease as wheel spindle and quill deflection has reached its new equilibrium level for finish grinding.

In a preferred method for grinding such workparts with improved bore roundness, the change from a liquid coolant stream to coolant mist is made in response to a change in grinding wheel motor power, i.e., the liquid coolant stream(s) is discontinued with only the coolant mist discharging over the grinding wheel when grinding wheel motor power has decreased to a level corresponding to that associated with finish grinding. Typically, coolant mist is maintained until the end of spark-out. Should grinding wheel motor power increase above the finish grind level for some reason, the liquid coolant stream(s) could be returned.

With coolant control in accordance with the present invention during internal grinding of a cylindrical bore requiring a bore roundness not deviating by more than 50 millionths of an inch from a perfect circle, we have been able to achieve consistently a bore roundness deviation of below 40 millionths of an inch. Without such coolant control, bore roundness deviation of about 100 millionths of an inch was the least deviation obtainable in bore roundness.

DESCRIPTION OF PREFERRED EMBODIMENTS

Figure 1:
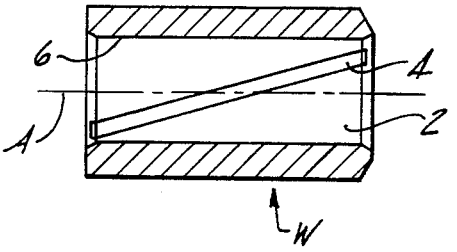
FIG. 1 illustrates in longitudinal cross-section a workpart with a longitudinal bore having a bore wall interrupted by a longitudinally extending oil groove inclined at an angle to the longitudinal axis of the workpart.

FIG. 1 illustrates a sintered iron powder workpart W having a longitudinal cylindrical bore 2 with an oil groove 4 machined in the bore wall 6 and extending axially along the length of the bore at an angle relative to the workpart axis A as shown. In a typical application, the roundness of bore 2 at any location along the axis A must not deviate more than 50 millionths of an inch (0.00005 inch) from a perfect circle.

Figure 2:
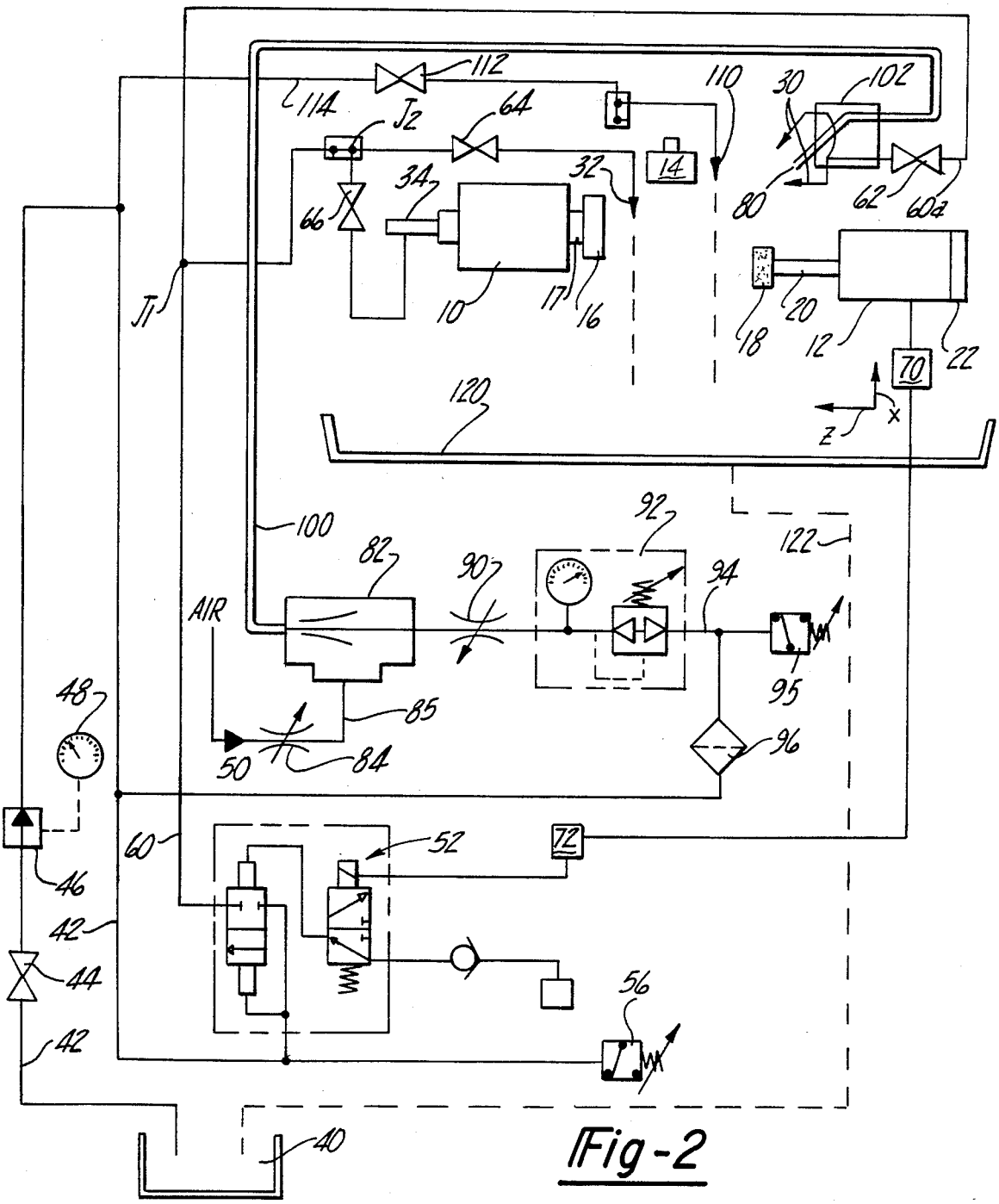
FIG. 2 is a schematic illustration of the coolant control system.
Figure 3:
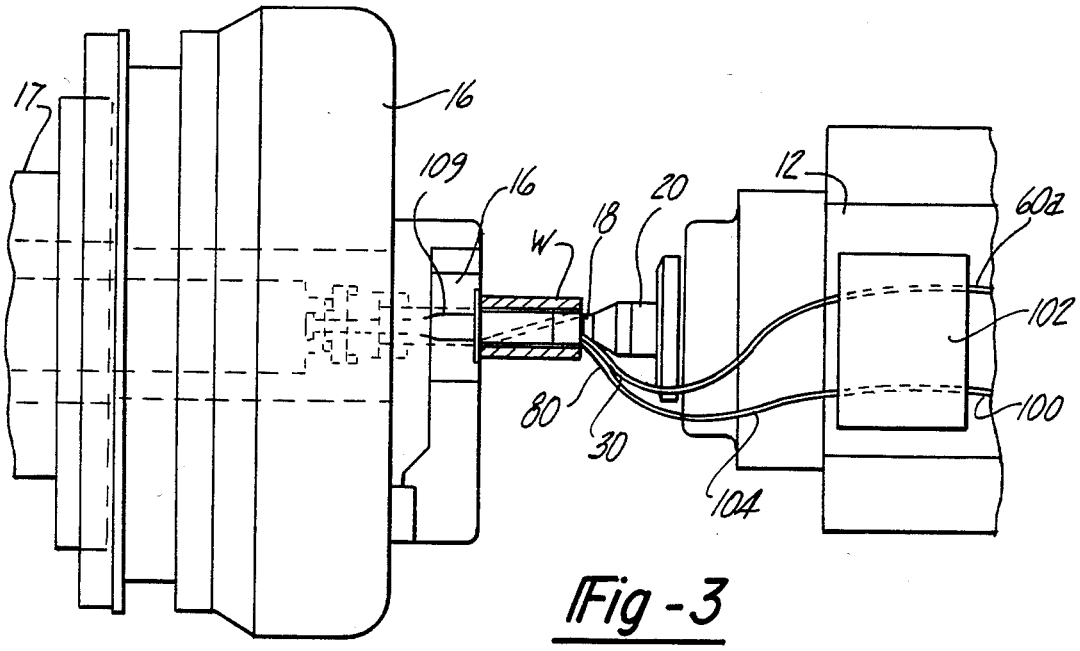
FIG. 3 is a plan view of the wheel head and workhead of a grinding machine with coolant nozzles positioned in accordance with the invention.

FIG. 2 illustrates schematically a grinding machine workhead 10, wheelhead 12 and rotary dresser 14 as well as the coolant control system for effecting grinding in accordance with the method of the invention. The workhead 10, wheelhead 12 and rotary dresser 14 are of conventional construction, a grinding machine having such components thereon being available under the trademark Lectraline LL2-10 grinding machine from Bryant Grinder Corporation, Springfield, Vermont 05156. As is well known, the workpart W is chucked in the chuck 16 of the workhead and is rotated by the workhead spindle 17 during grinding but at a lesser speed of revolution than the grinding wheel 18 is rotated by spindle 20 of the wheelhead motor 22. The grinding wheel is reciprocated axially inside the bore of the chucked workpart while being radially fed against the bore wall 6 in grinding relation. Reciprocable movement of the grinding wheel in the workpart bore is effected by a so-called Z-axis slide (not shown) which moves in the Z direction and radial feeding of the wheel against the bore wall is effected by a so-called X-axis slide (not shown) moveable in the X-direction, all as is well known; for example, as shown in the Reda et al. U.S. Pat. No. 4,419,612 issued Dec. 6, 1983, the teachings of which are incorporated herein by reference. As will become apparent, internal grinding of bore wall 6 is effected in a successive rough grinding stage, finish grinding stage and spark-out stage. During rough grinding, the radial feed rate of the wheel against the bore wall is high; e.g., 0.001 inch/second, while during finish grinding the radial feed rate of the wheel is relatively low; e.g., 0.00025 inch/second. These feed rates are of course provided by movement of the X-axis slide under suitable servo loop control using ball screws by the CNC unit of the grinding machine, e.g., as described in the aforementioned Reda et al. U.S. Pat. No. 4,419,612. During spark-out (also referred to in the art as dwell or tarry), the grinding wheel is positioned by the X-axis slide in contact with the bore wall 6 with an essentially zero radial feed rate until grinding force decreases to or near the so-called threshold level below which no further grinding occurs as is well known.

In accordance with the method of the invention, one or more liquid coolant streams are directed over the grinding wheel 18 during the rough grinding stage at the relatively high feed rates. For example, as shown schematically in FIG. 2, liquid coolant streams are directed over the wheel 18 from a pair of first nozzles 30 and from a second nozzle 32 (for face grinding only) to provide a coolant flow over the wheel. The first nozzles 30 are mounted on the Z-axis or X-axis slide for movement with the wheelhead 12 preferably with one nozzle above and one below coolant mist nozzle 80 while the second nozzle 32 is fixed and supported in position on the bed (not shown) of the grinding machine. An additional liquid coolant stream may be provided through a conduit 34 extending through the hollow workhead spindle 17 to discharge a liquid coolant stream axially into the workpart bore 2.

Liquid coolant, such as a soluble oil-water mixture, is provided to nozzles 30,32 and conduit 34 from a central source 40 of pressurized liquid coolant, e.g., coolant at 50 psi. The liquid coolant is supplied by means of supply conduit 42 having a gate valve 44 and a pressure regulator or reducer 46 with pressure gage 48. The pressurized liquid coolant flows to a solenoid shut-off valve 50 which is controlled by a pneumatic pilot valve 52. Solenoid shut-off valve 50 and pilot valve 52 are available as a unit under the designation Airmatic No. 310312 from Airmatic-Allied, Inc., Wilmington, Ohio. A pressure switch 56 is also connected to supply conduit 42 and is set to release at, for example, 45 psi. When the solenoid shut-off valve 50 is open, liquid coolant flows through conduit 60 to junction $J_1$ where the liquid coolant is split into two streams, one flowing through ball valve 62 in conduit 60*a* to first nozzle 30 and the other flowing to second junction $J_2$ where part of the stream is directed through ball valve 64 to second nozzle 32 and the remainder is directed through ball valve 66 to conduit 34 extending through the workhead spindle 17.

In accordance with the present invention, solenoid valve 50 is closed when the rough grinding stage is completed, as evidenced by the change in radial wheel feed rate from the high rate for rough grinding to the lower rate for finish grinding as controlled by the CNC control of the grinding machine. The watt-meter 70 detects the lower wheel spindle motor power (lower torque load on the motor and grinding wheel) resulting from the lower radial wheel feed rate employed during the finish grind stage and generates a signal which is fed to controller 72. Controller 72, which may be a conventional relay circuit or the machine computer numerical control unit itself actuates the pneumatic pilot vlave 52 to close solenoid valve 50 and thereby discontinue liquid coolant flow to nozzles 30,32 and conduit 34. Thus, upon completion of the rough grinding stage as detected by the drop in wheel spindle motor power, all flow of liquid coolant streams over the wheel 18 and workpart W is terminated.

Shut-off of the liquid coolant streams could be triggered in other ways; e.g., a time delay switch could be used to permit liquid coolant flow through nozzles 30,32 and conduit 34 for a preselected period of time after the radial wheel feed rate is changed by the machine CNC control to allow the actual grinding rate to decrease as wheel spindle and quill deflection reach its new equilibrium level associated with the finish grinding stage. Thus, solenoid valve 50 would be closed slightly later than the time at which the wheel feed rate is changed.

Of course, the grinding machine CNC control could be adapted to directly actuate controller 72 at the time of feed rate change or after a selected time delay period thereafter.

In one embodiment of the invention, a coolant mist is also directed over the grinding wheel 18 during the rough grinding stage by nozzle 80 carried and supported on the wheelhead 12. The coolant mist generating components are located at tee fitting 82 which is fed compressed air at for example about one (1) cubic feet per minute through a needle metering valve 85 in air conduit 84 connected to a source of compressed air (80 psi) and which is fed liquid coolant at for example about 5 gallons per minute through a needle metering valve 90 and pressure regulator or reducer 92 in a liquid coolant conduit 94 connected to supply conduit 42. A pressure release valve or switch 95 is provided in conduit 94 and is set to release at 10 psi to indicate replacement of filter 96 is necessary. Regulator 92 controls coolant pressure at 1–2 psi for metering to the tee fitting 82.

Figure 4:
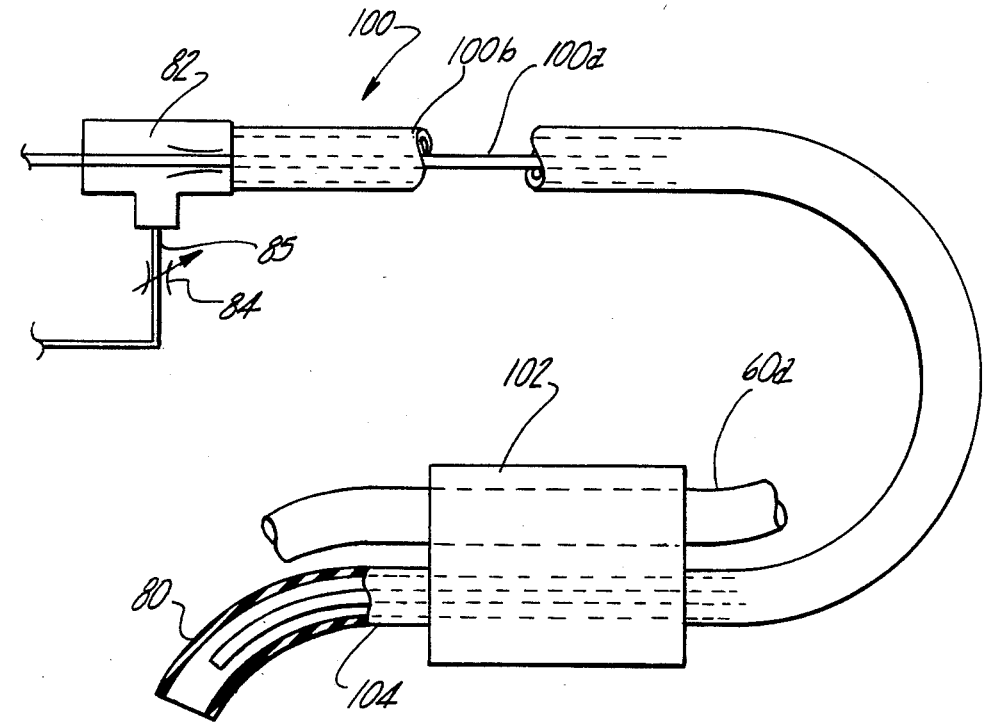
FIG. 4 is an elevation of the coolant mist nozzle.
Figure 4:
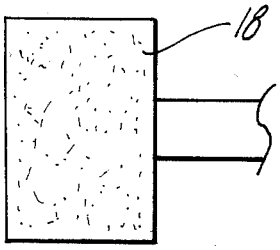

As shown best in FIG. 4, a double wall conduit 100 extends from the tee-fitting 82 with liquid coolant flow through inner tube 100*a* and compressed air in the annular space between the inner tube 100*a* and coaxial outer tube 100*b*. Conduit 100 extends to a coolant support manifold 102 mounted on the wheelhead 12 or Z-axis or X-axis slide (not shown) for movement with the wheel 18. The coolant support manifold merely provides mechanical support for conduit 100 and conduit 60*a*. Extending from the manifold 102 is a double wall nozzle tube 104 which is formed as shown at its end to provide nozzle 104*a* to generate the coolant mist and direct it over the wheel 18 as shown in FIG. 4. It is apparent that nozzle 104*a* is defined by outer tube 104*b* and termination upstream of inner tube 104*c* so that the mist can be generated in the nozzle. As used herein and in the claims, coolant mist is intended to mean discrete liquid coolant droplets suspended in a gaseous stream where the gaseous stream could be compressed air as described or other suitable gases. Typical liquid droplet content of the mist is approximately 4 drops per second or about 0.004 gallons per minute using the above flow parameters.

As mentioned above, the coolant mist may be directed over the grinding wheel during the rough grinding stage in addition to the liquid coolant streams from nozzles 30,32. In this event, when the solenoid shut-off valve 50 is closed after completion of rough grinding, only the coolant mist will continue to be discharged over the grinding wheel during the finish grind stage and during the spark-out stage. No liquid coolant streams will be discharged. We have found that the use of the coolant mist over the grinding wheel 18 during finish grind and spark-out unexpectedly and significantly enhances the bore roundness tolerance achievable and allowed us to achieve bore roundness tolerance below 40 millionths of an inch (0.00004 inch), this being well within the prescribed bore roundness tolerance of 50 millionths of an inch from a perfect circle. Without the method described hereinabove, applicants were able to achieve a bore roundness tolerance or deviation of only 100 millionths (0.0001 inch) from a perfect circle. The method of invention for the first time permitted us to internally grind the bore 2 at production rates with bore roundness deviation well within the prescribed tolerance.

Those skilled in the art will appreciate that in other embodiments of the invention suitable controls could be used to switch on the coolant mist at the completion of the rough grind stage rather than have the coolant mist discharging during rough grind and continuing on during the finish grind and spark-out stage. For example, controller 72 could be adapted to actuate a solenoid valve (not shown) in conduit 94 to permit liquid coolant flow to the tee fitting 82 at the time of radial wheel feed rate change from high to low or after a delay period following such change, as described hereinabove for termination of liquid coolant discharge from nozzles 30,32 and conduit 34.

In accordance with another embodiment of the invention, solenoid valve 50 is closed when the rough grinding stage is completed or following a delay period thereafter as evidenced by a change in bore size to a preselected dimension for initiation of finish grinding. In this embodiment, conventional in-process gaging having gaging fingers 109 would measure bore size during grinding. Bore size information input into the CNC unit of the machine would cause valve 50 to be closed when the preselected bore size for finish grinding is reached.

Of course, during dressing of the grinding wheel by dresser 14, a liquid coolant stream is discharged from a nozzle 110 supplied with liquid coolant through ball valve 112 in conduit 114 which is connected to supply conduit 42 as shown.

As shown in FIG. 2, a coolant collection tray 120 is provided on the machine bed to collect coolant discharged during grinding and return same to the central source 40 via a return conduit 122.

Although certain preferred embodiments of the invention have been described hereinabove and illustrated in the Figures, it is to be understood that modifications and changes can be made therein without departing from the spirit and scope of the invention as defined in the appended claims.

We claim:

1. In grinding an internal cylindrical bore having an interruption in the bore wall which adversely affects the bore roundness tolerance achievable by said grinding, the steps for improving bore roundness comprising radially feeding a rotating grinding wheel relative to the bore longitudinal axis and bore wall, respectively, in a rough grind stage with a high radial feed rate and with a stream of liquid coolant discharging on the grinding wheel and in a subsequent finish grind stage with the radial feed rate reduced and with the liquid coolant stream discontinued and a mist of liquid coolant droplets suspended in a gaseous stream discharging on the grinding wheel.

2. The method of claim 1 wherein the liquid coolant stream discharge on the grinding wheel is discontinued when the feed rate is reduced to that for the finish grind stage after a delay period following such reduction.

3. The method of claims 1 or 2 wherein a spark-out stage follows the finish grind stage and wherein the mist of liquid coolant droplets suspended in a gaseous stream is discharged on the grinding wheel during both the finish grind and spark-out stages without discharge of the liquid coolant stream.

4. In grinding an internal cylindrical bore having an interruption in the bore wall which adversely affects the bore roundness achievable by said grinding, the steps for improving bore roundness comprising radially feeding a rotating grinding wheel relative to the bore longitudinal axis and bore wall, respectively, in a rough grind stage at a high feed rate and in a subsequent finish grind stage at a reduced feed rate including monitoring the torque load on said grinding wheel during said rough grind stage and finish grind stage, wherein a stream of liquid coolant is discharged on the grinding wheel during the rough grind stage, said liquid coolant stream is discontinued when said torque load decreases as a result of said reduced feed rate and a mist of liquid coolant droplets suspended in a gaseous stream is discharged on the grinding wheel during the finish grind stage.

5. The method of claim 4 wherein a spark-out stage follows the finish grind stage and wherein the mist of liquid coolant droplets suspended in a gaseous stream is discharged on the grinding wheel during both the finish grind and spark-out stages without discharge of the liquid coolant stream.

6. In grinding an internal cylindrical bore having an interruption in the bore wall which adversely affects the bore roundness achievable by said grinding, the steps for improving bore roundness comprising radially feeding a rotating grinding wheel relative to the bore longitudinal axis and bore wall, respectively, in a rough grind stage at a high feed rate and in a subsequent finish grind stage at a reduced feed rate including monitoring bore size during said rough grind stage and finish grind stage, wherein a stream of liquid coolant is discharged on the grinding wheel during the rough grind stage, said liquid coolant stream is discontinued when said bore size reaches a preselected value for finish grinding and a mist of liquid coolant droplets suspended in a gaseous stream is discharged on the grinding wheel during the finish grind stage.

7. The method of claim 6 wherein a spark-out stage follows the finish grind stage and wherein the mist of liquid coolant droplets suspended in a gaseous stream is discharged on the grinding wheel during both the finish grind and spark-out stages without discharge of the liquid coolant stream.

* * * * *